US007185565B1

(12) United States Patent
Hu

(10) Patent No.: US 7,185,565 B1
(45) Date of Patent: Mar. 6, 2007

(54) SCREWDRIVER HAVING A RATCHET MECHANISM

(76) Inventor: Cheng-Tsan Hu, No. 205, Tu Tzu Tou, Tu Tou Village, Tainan Hsien (TW)

( * ) Notice: Subject to any disclaimer, the term of this patent is extended or adjusted under 35 U.S.C. 154(b) by 0 days.

(21) Appl. No.: 11/459,624

(22) Filed: Jul. 24, 2006

(51) Int. Cl.
*B25B 13/46* (2006.01)
*B25B 15/04* (2006.01)
*B25B 15/00* (2006.01)

(52) U.S. Cl. ..... 81/62; 81/63.1

(58) Field of Classification Search ..... 81/62, 81/63.1; 192/43.1, 43.2
See application file for complete search history.

(56) References Cited

U.S. PATENT DOCUMENTS 6,260,446 B1 * 7/2001 Hu ..... 81/62
6,523,439 B1 * 2/2003 Huang ..... 81/63.1
6,644,147 B1 * 11/2003 Huang ..... 81/62
6,817,458 B1 * 11/2004 Gauthier ..... 192/43.1
6,902,047 B2 * 6/2005 Ting ..... 192/43.2
6,948,605 B1 * 9/2005 Gauthier ..... 192/43.1
6,976,409 B2 * 12/2005 Shu ..... 81/62
6,997,084 B1 * 2/2006 Gao et al. ..... 81/62
7,014,023 B1 * 3/2006 Gauthier ..... 192/43.1
7,055,410 B2 * 6/2006 Hu ..... 81/62
2005/0204869 A1 * 9/2005 Shu ..... 81/58.4

* cited by examiner

*Primary Examiner*—David B. Thomas
(74) *Attorney, Agent, or Firm*—Anthony S. King; WPAT, P.C.

(57) ABSTRACT

A screwdriver having a ratchet mechanism includes a tool sleeve, a handle, a first detent, a first elastic element, a second detent, a second elastic element, and a switch assembly. The tool sleeve is provided with a ratchet head formed with ratchet teeth. The handle has a hollow chamber to accommodate the tool sleeve and a ratchet base therein. The ratchet base is to accommodate the ratchet head with the ratchet teeth, the detents and the elastic elements. Each of the detents engages with the ratchet teeth of the ratchet head. The switch assembly is pivotally connected to the handle and comprises a first stud and a second stud to engage with the first detent and the second detent, respectively.

3 Claims, 5 Drawing Sheets

SCREWDRIVER HAVING A RATCHET MECHANISM

BACKGROUND OF THE INVENTION

1. Field of the Invention

The present invention relates to a screwdriver having a ratchet mechanism, in particular to a ratchet mechanism provided in a rear portion of a handle to prevent it from touching accidentally by means of a switch assembly having studs to link a detent at one side to disengage from ratchet teeth of a ratchet head so as to change the turning direction of a tool sleeve.

2. Description of the Prior Art

There are various ratchet hand tools on the market. Each has its special function, such as U.S. Pat. No. 5,875,693 (incorporated herein by reference) which uses a gear to secure and to change the turning direction. The gear may get damaged easily, causing meshing inappropriately.

A ratchet mechanism for a screwdriver, such as U.S. Pat. Nos. 6,070,503, 6,253,654 and 6,854,363, (all of which are incorporated herein by reference) is provided at a front portion or at a front end of a handle, which may accidentally touch an adjusting switch when operating the screwdriver.

SUMMARY OF THE INVENTION

It is the primary objective of the present invention to provide a screwdriver having a ratchet mechanism, which can be operated accurately to change the turning direction of a tool sleeve.

It is another objective of the present invention to provide a screwdriver having a ratchet mechanism, which is not easy to be worn out and can last longer.

It is a further objective of the present invention to provide a screwdriver having a ratchet mechanism, which provides an accurate position.

The present invention comprises a tool sleeve, a handle, a first detent, a first elastic element, a second detent, a second elastic element, and a switch assembly. The tool sleeve comprises a grove and a ratchet head. The tool sleeve is provided with a tool head. The ratchet head is formed with ratchet teeth. The handle has a hollow chamber to accommodate the tool sleeve and a ratchet base. The ratchet base comprises a compartment, a first recess and a second recess. The first and second recesses interconnect with the compartment. The compartment accommodates the ratchet head with the ratchet teeth. The first detent is a plate and comprises a stud to be connected to the ratchet base. The first elastic element is disposed between the first detent and the ratchet base, urging the first detent to engage with the ratchet teeth of the ratchet head. The second detent is a plate and comprises a stud to be connected to the ratchet base. The second elastic element is disposed between the second detent and the ratchet base, urging the second detent to engage with the ratchet teeth of the ratchet head. The switch assembly is secured to the tool sleeve and comprises a first stud and a second stud. The first stud engages with the first detent, and the second stud engages with the second detent. The switch assembly comprises a through hole and a fastener. The ratchet head is inserted through the through hole of the switch assembly and secured by the fastener. The handle further comprises a disc having a through hole.

DETAILED DESCRIPTION OF THE PREFERRED EMBODIMENT

Figure 1:
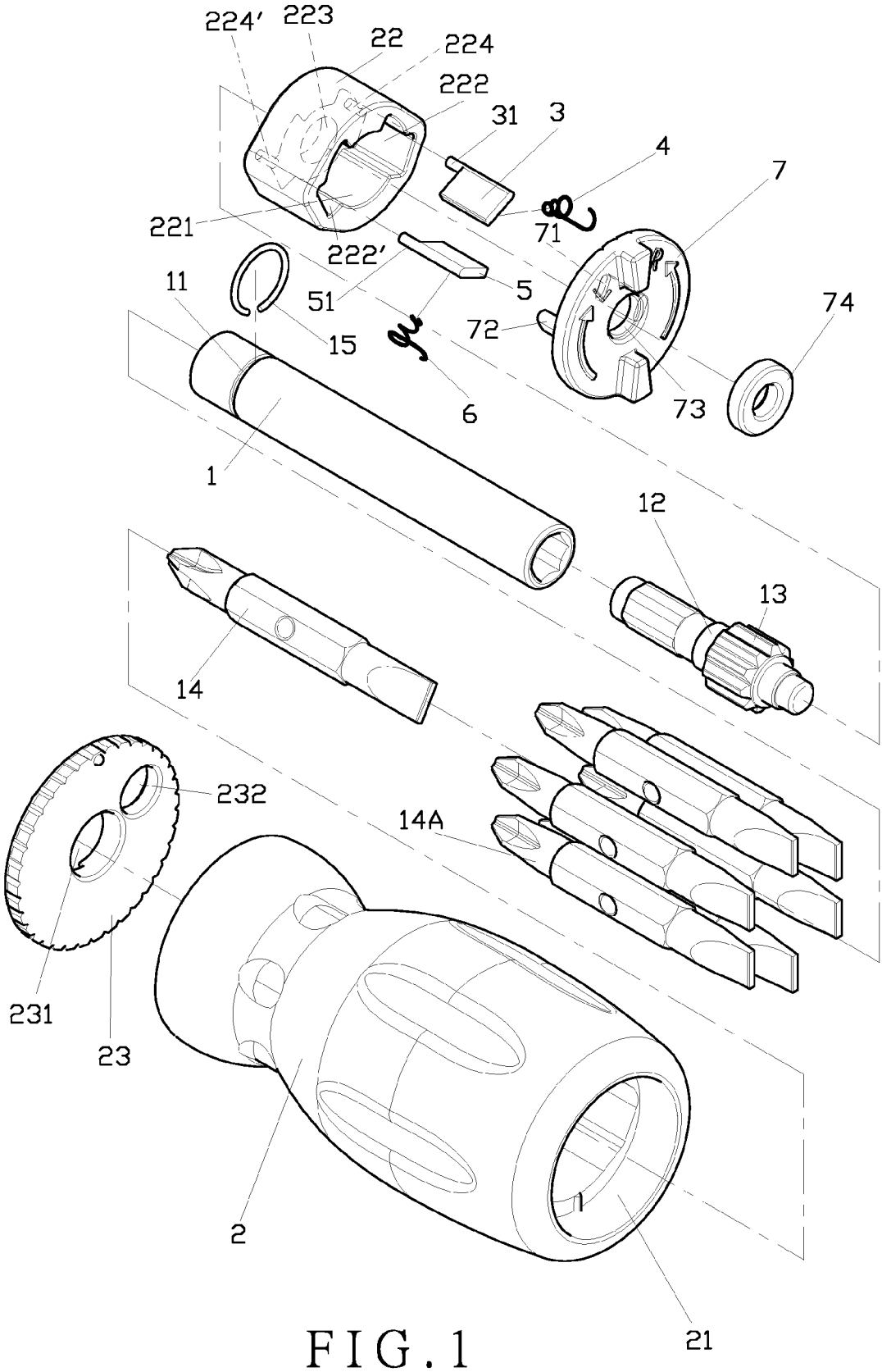
FIG. 1 is an exploded view of a preferred embodiment of the present invention.
Figure 2:
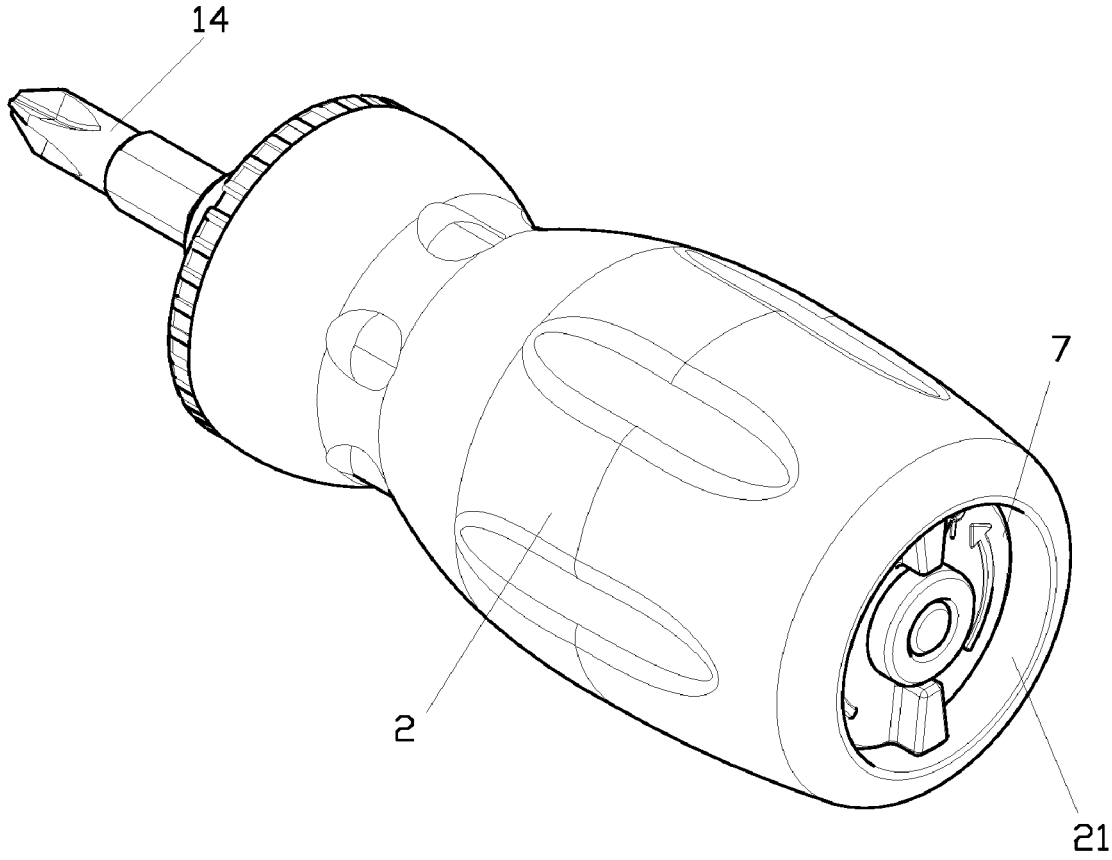
FIG. 2 is a perspective view of the preferred embodiment of the present invention.

As shown in FIGS. 1 and 2, a preferred embodiment of the present invention comprises a tool sleeve 1, a handle 2, a first detent 3, a first elastic element 4, a second detent 5, a second elastic element 6, and a switch assembly 7.

The tool sleeve 1 comprises a groove 11 at a front portion and a ratchet head 12 at a rear end thereof. The tool sleeve 1 has a front end to receive a tool head 14 therein. The ratchet head 12 is formed with ratchet teeth 13 on its outer surface. The tool sleeve 1 may be coupled with other tool heads 14A stored in the handle 2, and a C-shaped fastener 15 is provided on the tool sleeve 1.

The handle 2 comprises a hollow chamber 21 therein. The tool sleeve 1 is accommodated in a front portion of the chamber 21. A ratchet base 22 is provided in a rear portion of the chamber 21. The ratchet base 22 comprises a compartment 221, a first recess 222, a second recess 222', an aperture 223, a first hole 224 and a second hole 224'. The compartment 221 interconnects with the first recess 222 and the second recess 222'. The aperture 223, the first hole 224 and the second hole 224' are disposed at the bottom of the ratchet base 22. The ratchet head 12 with the ratchet teeth 13 is accommodated in the compartment 221. The tool sleeve 1 is inserted through the aperture 223. The handle 2 further comprises a disc 23 which is pivotally connected to the tool sleeve 1 and secured by the fastener 15 to confirm its movement. The disc 23 comprises a through hole 231 and a side hole 232. The tool sleeve 1 is inserted through the through hole 231. The side hole 232 is to replace the tool heads 14A.

The first detent 3 is a plate and accommodated in the recess 222 of the ratchet base 22 of the handle 2. The first detent 3 comprises a stud 31 to be inserted into the hole 224 of the ratchet base 22.

The first elastic element 4 is located in the recess 222 between the first detent 3 and the ratchet base 22, urging the first detent 3 to engage with the ratchet teeth 13 of the ratchet head 12.

The second detent 5 is a plate and accommodated in the recess 222' of the ratchet base 22 of the handle 2. The detent 5 comprises a stud 51 to be inserted into the hole 224' of the ratchet base 22.

The second elastic element 6 is located in the recess 222' between the second detent 5 and the ratchet base 22, urging the second detent 5 to engage with the ratchet teeth 13 of the ratchet head 12.

The switch assembly 7 is secured to the tool sleeve 1 and pivotally connected to the handle 2. The switch assembly 7 comprises a first stud 71, a second stud 72, a through hole 73 and a fastener 74. The through hole 71 is for the tool sleeve 1 to be inserted therethrough, and the fastener 74 is secured to the tool sleeve 1. The first stud 71 engages with the first detent 3, and the second stud 72 engages with the second detent 5.

The tool sleeve 1, the ratchet base 22, the ratchet head 12 and the switch assembly 7 are accommodated in the handle 2 in sequence. The first detent 3, the first elastic element 4, the second detent 5, and the second elastic element 6 are accommodated in the ratchet base 22. The first detent 3 and the second detent 5 engage with the ratchet teeth 13 of the ratchet head 12, respectively. By adjusting the first stud 71 and the second stud 72 of the switch assembly 7 to engage with and to link the first detent 3 and the second detent 5, respectively, the turning direction of the tool sleeve 1 is able to change.

Figure 3:
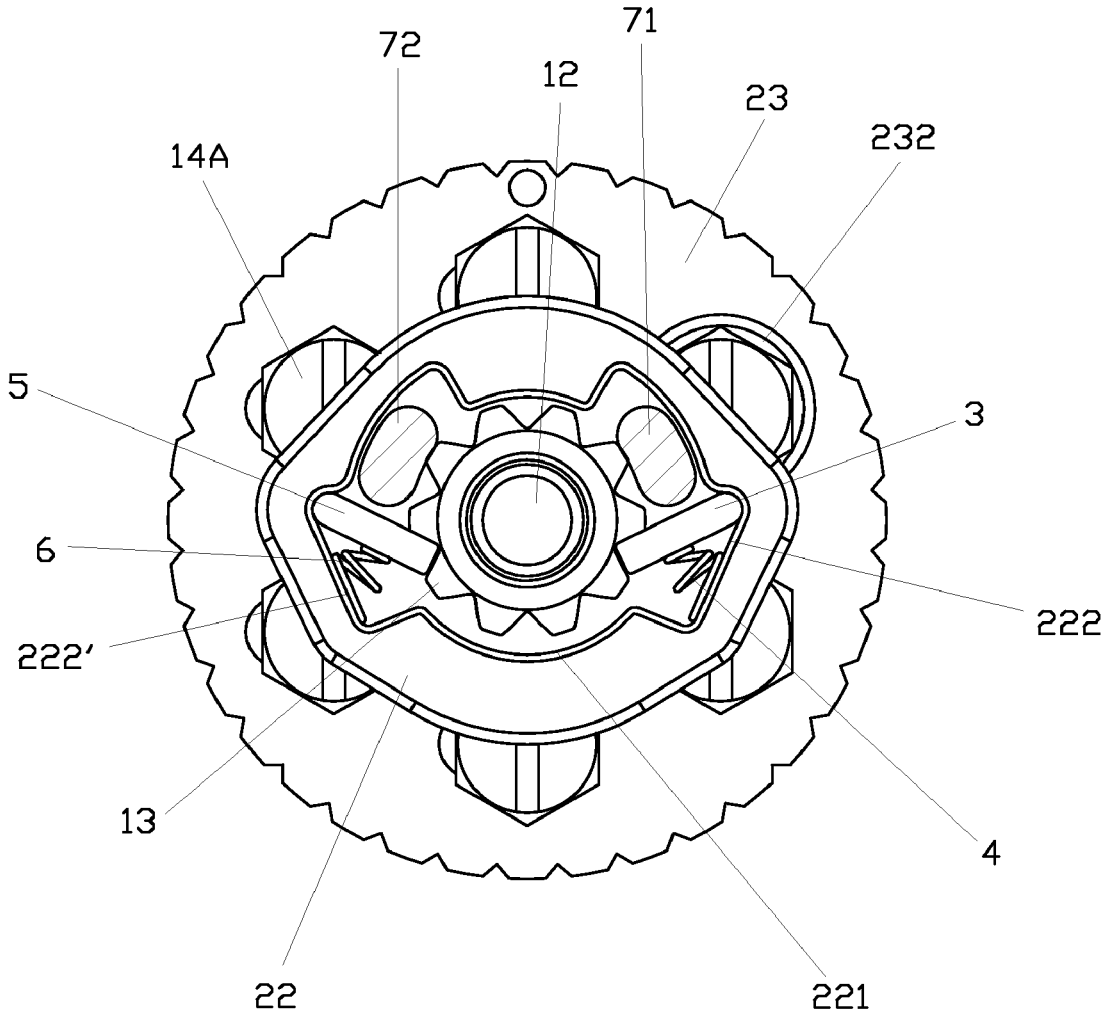
FIG. 3 is a cross-sectional view of the preferred embodiment of the present invention in a two-way engagement status.

FIG. 3 shows two-way engagement of the present invention. When the switch assembly 7 is located at the center, both the first detent 3 and the second detent 5 are engaged with the ratchet teeth 13 of the ratchet head 12. The first stud 71 and the second stud 72 are disengaged from the first detent 3 and the second detent 5, thus the tool head is direct linked with the handle 2.

Figure 4:
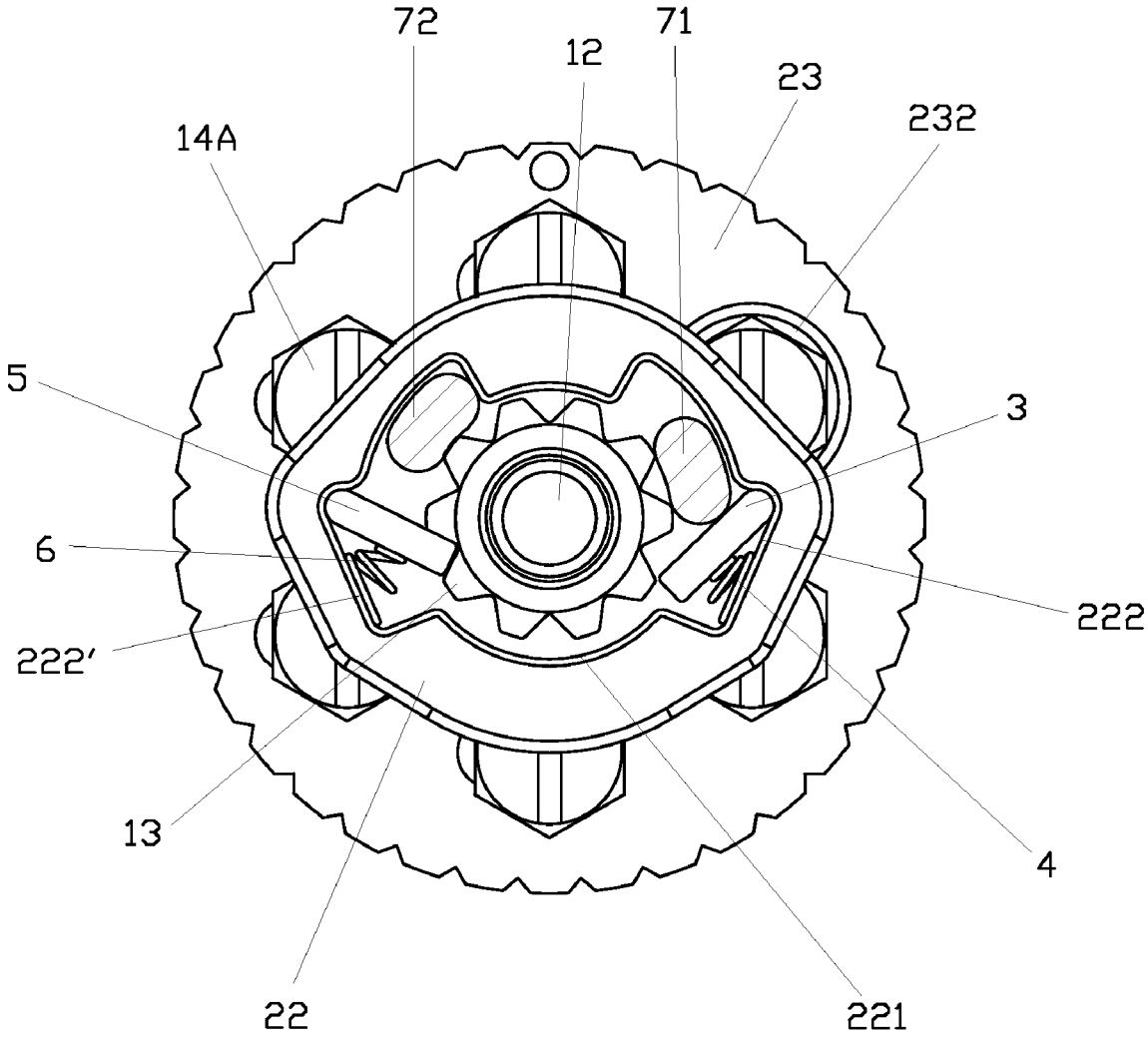
FIG. 4 is a cross-sectional view of the preferred embodiment the present invention in a clockwise engagement status.
Figure 5:
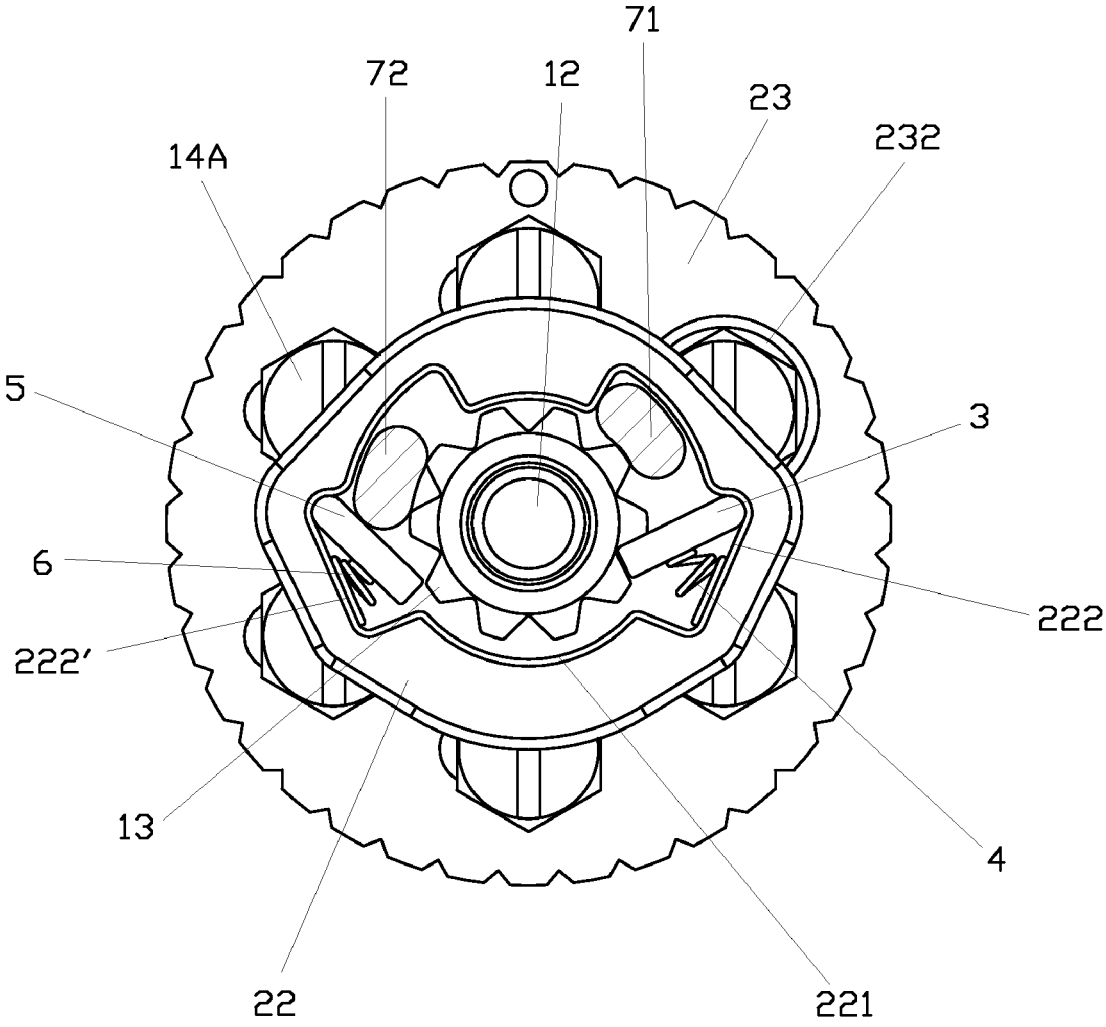
FIG. 5 is a cross-sectional view of the preferred embodiment the present invention in a counterclockwise engagement status.

As shown in FIGS. 4 and 5, the turning direction of the operation of the present invention is changed. FIG. 4 shows a clockwise turning direction. FIG. 5 shows a counterclockwise turning direction. When the switch assembly 7 is pushed towards one side, either of the first stud 71 and the second stud 72 will link the first detent 3 or the second detent 5 to be retreated from the ratchet teeth 13 of the ratchet head 12, thus the turning direction of the tool sleeve 1 is able to change towards the direction as desired.

Thus, specific embodiments and applications of screwdriver having a ratchet mechanism have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

What is claimed is:

1. A screwdriver having a ratchet mechanism comprising:

a tool sleeve provided with a ratchet head, said ratchet head comprising ratchet teeth;

a handle comprising a hollow chamber to accommodate said tool sleeve and a ratchet base, said ratchet base comprising a compartment, a first recess and a second recess, said first and second recesses interconnecting with said compartment, said compartment accommodating said ratchet head and said ratchet teeth;

a first detent accommodated in said first recess of said ratchet base of said handle, said first detent comprising a stud to be connected to said ratchet base;

a first elastic element disposed in said first recess and engaging with said first detent and said ratchet base, urging said first detent to engage with said ratchet teeth of said ratchet head;

a second detent accommodated in said second recess of said ratchet base of said handle, said second detent comprising a stud to be connected to said ratchet base;

a second elastic element disposed in said second recess and engaging with said second detent and said ratchet base, urging said second detent to engage with said ratchet teeth of said ratchet head;

a switch assembly pivotally connected to said handle comprising a first stud and a second stud, said first stud engaging with said first detent, said second stud engaging with said second detent; and wherein said handle further comprises a disc having a through hole.

2. The screwdriver having a ratchet mechanism, as recited in claim 1, wherein said switch assembly comprises a through hole and a fastener, said ratchet head being inserted through said through hole and secured by said fastener.

3. A screwdriver having a ratchet mechanism comprising: a tool sleeve provided with a ratchet head, said ratchet head comprising ratchet teeth; a handle to accommodate said tool sleeve comprising a ratchet base at a rear portion thereof, said ratchet base comprising a first detent, a first elastic element, a second detent, and a second elastic element; said first elastic element and said second elastic element urging said first detent and said second detent to engage with said ratchet teeth of said ratchet head; and a switch assembly connected to a rear end of said handle comprising a first stud and a second stud to engage with said first detent and said second detent, respectively.

* * * * *